US006886376B2

(12) United States Patent
Kuo

(10) Patent No.: US 6,886,376 B2
(45) Date of Patent: May 3, 2005

(54) LOCK FOR SECURING AN ARTICLE ON DISPLAY

(75) Inventor: Lambert Kuo, Tainan (TW)

(73) Assignee: Acco Brands, Inc., Lincolnshire, IL (US)

( * ) Notice: Subject to any disclaimer, the term of this patent is extended or adjusted under 35 U.S.C. 154(b) by 0 days.

(21) Appl. No.: 10/455,072

(22) Filed: Jun. 4, 2003

(65) Prior Publication Data

US 2004/0016270 A1 Jan. 29, 2004

Related U.S. Application Data

(63) Continuation of application No. 10/201,281, filed on Jul. 24, 2002, now Pat. No. 6,591,642.

(51) Int. Cl.[7] ..... E05B 69/00; E05B 73/00
(52) U.S. Cl. ..... 70/58; 70/49; 70/57.1
(58) Field of Search ..... 70/58, 57.1, 14, 70/30, 49, 232, 18, 19, 361; 248/551–553; 361/732

(56) References Cited

U.S. PATENT DOCUMENTS 5,447,049 A 9/1995 Shieh
5,791,171 A * 8/1998 Kelley ..... 70/58
5,799,520 A 9/1998 Laabs et al.
5,913,907 A 6/1999 Lee
5,983,679 A * 11/1999 Reyes ..... 70/58
6,058,744 A * 5/2000 Ling ..... 70/28
6,155,088 A * 12/2000 Murray et al. ..... 70/58
6,227,017 B1 * 5/2001 Igelmund ..... 70/58
6,244,080 B1 * 6/2001 Sakurai ..... 70/14
6,244,082 B1 6/2001 Avganim
6,401,502 B1 * 6/2002 Yang ..... 70/30
6,449,992 B1 * 9/2002 Yu et al. ..... 70/58
6,619,080 B1 * 9/2003 Yu ..... 70/58
6,619,081 B1 * 9/2003 Yu ..... 70/58

FOREIGN PATENT DOCUMENTS

FR 2741375 A1 11/1995

* cited by examiner

*Primary Examiner*—John B. Walsh
(74) *Attorney, Agent, or Firm*—Townsend and Townsend and Crew LLP

(57) ABSTRACT

A lock for securing an article on display includes a casing having a front opening and a hook contiguous to the front opening, with a locking body received in the casing. The locking body is formed with a bolt having a front lip that is movable out of the casing through the front opening. In addition, the locking body is designed so that the front lip of the bolt may be extended out of the casing and securely kept alongside the hook until the lock is opened.

3 Claims, 4 Drawing Sheets

LOCK FOR SECURING AN ARTICLE ON DISPLAY

This application is a continuation application of U.S. patent application No. 10/201,281, filed on Jul. 24, 2002, now U.S. Pat. No. 6,591,642.

BACKGROUND OF THE INVENTION

1. Field of the Invention

The present invention relates to a lock for securing an article on display and, more particularly, to such a lock which is easy to be operated and convenient to be well kept.

2. Description of Related Art

There is often a need to secure an article on display, especially on public display. This is usually accomplished by a lock that has a wire cable looped through something immovable.

As shown in FIG. 5, a lock for this purpose generally includes a main body (50) having a plurality of dials (51) and a socket (52) for detachably receiving a separate hitching part (60). After or before a front hook of the hitching part (60) passes through a port in an article, the dials (51) are required to be turned into the preset combination to allow the rear disk-like end of the part (60) to be placed into the socket (52) and fixedly attached to the main body (50).

The lock is opened by turning the dials (51) into the present combination again before moving a slider (53) of the main body (50). It is at this time that the hitching part (60) can be detached from the main body (50).

In this conventional lock, it is clear that the dials (51) must be turned either for the attachment of the hitching part (60) to or the detachment of the hitching part (60) from the main body (50), which is a difficult operation for a user.

Additionally, the conventional lock is not convenient to be well kept because the separate hitching part (60) is often lost and the remaining main body (50) becomes useless.

Therefore, it is an objective of the invention to provide a lock for securing an article on display to mitigate and/or obviate the aforementioned problems.

SUMMARY OF THE INVENTION

The object of the present invention is to provide a lock which is easy to be operated.

Another object of the present invention is to provide a lock which is convenient to be well kept.

Other objects, advantages and novel features of the invention will become more apparent from the following detailed description when taken in conjunction with the accompanying drawings.

DETAILED DESCRIPTION OF THE PREFERRED EMBODIMENT

Figure 1:
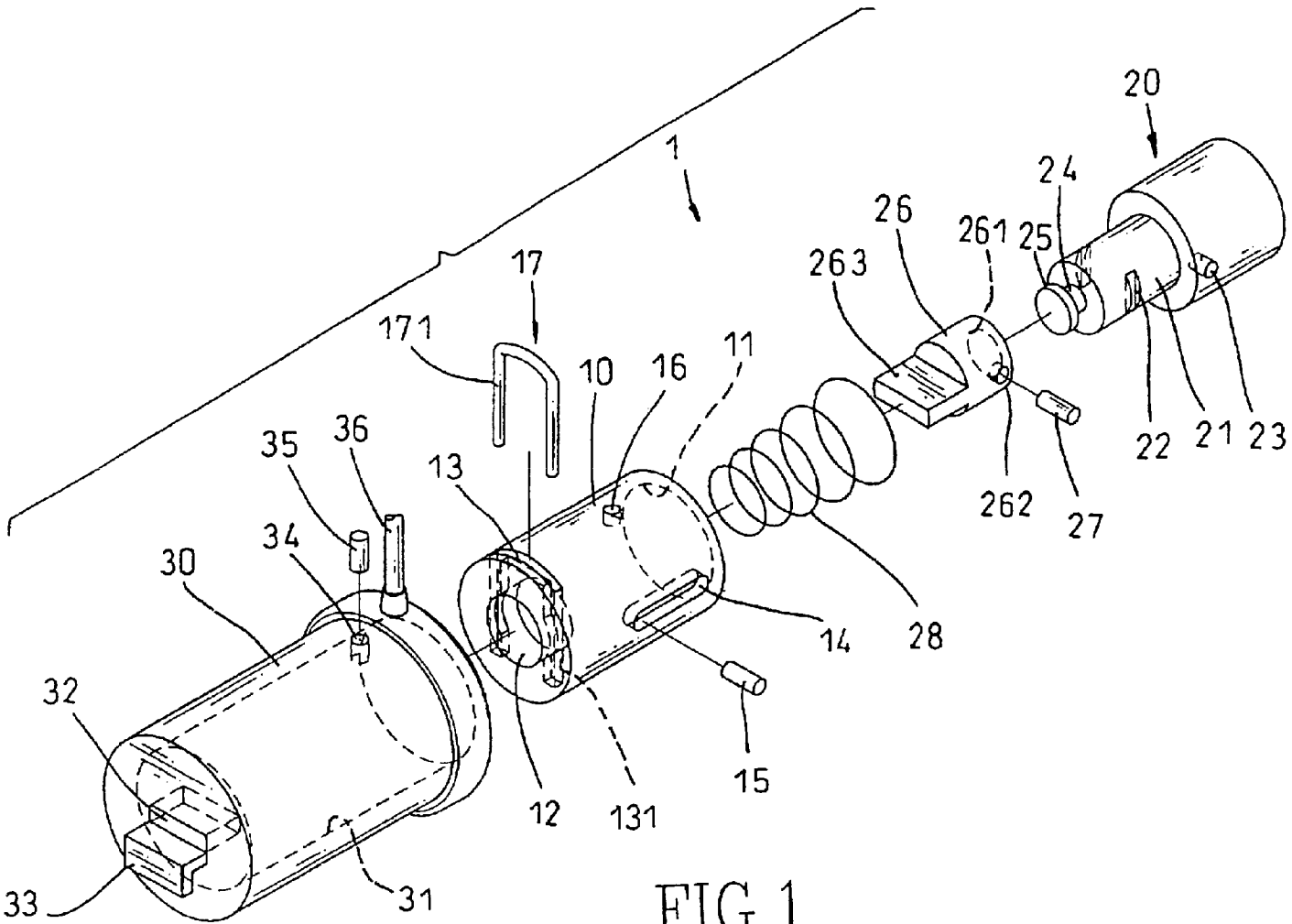
FIG. 1 is an exploded perspective view of a preferred embodiment of a lock in accordance with the present invention for securing an article on display.

Referring to FIG. 1, a lock in accordance with the present invention includes a casing (30) having a front opening (32) and a hook/first locking leg (33) including a shaft and an engagement portion contiguous to the opening (32), with a wire cable (36) attached to a periphery of the casing (30). The casing (30) is further formed with a rear opening (31) for receiving a locking body (1).

The locking body (1) includes a hollow body (10) received in the casing (30). The hollow body (10) has a rear chamber (11), a front through-hole (12) in alignment with the front opening (32) of the casing (30), and preferably a longitudinal groove (14) defined therein.

Figure 2:
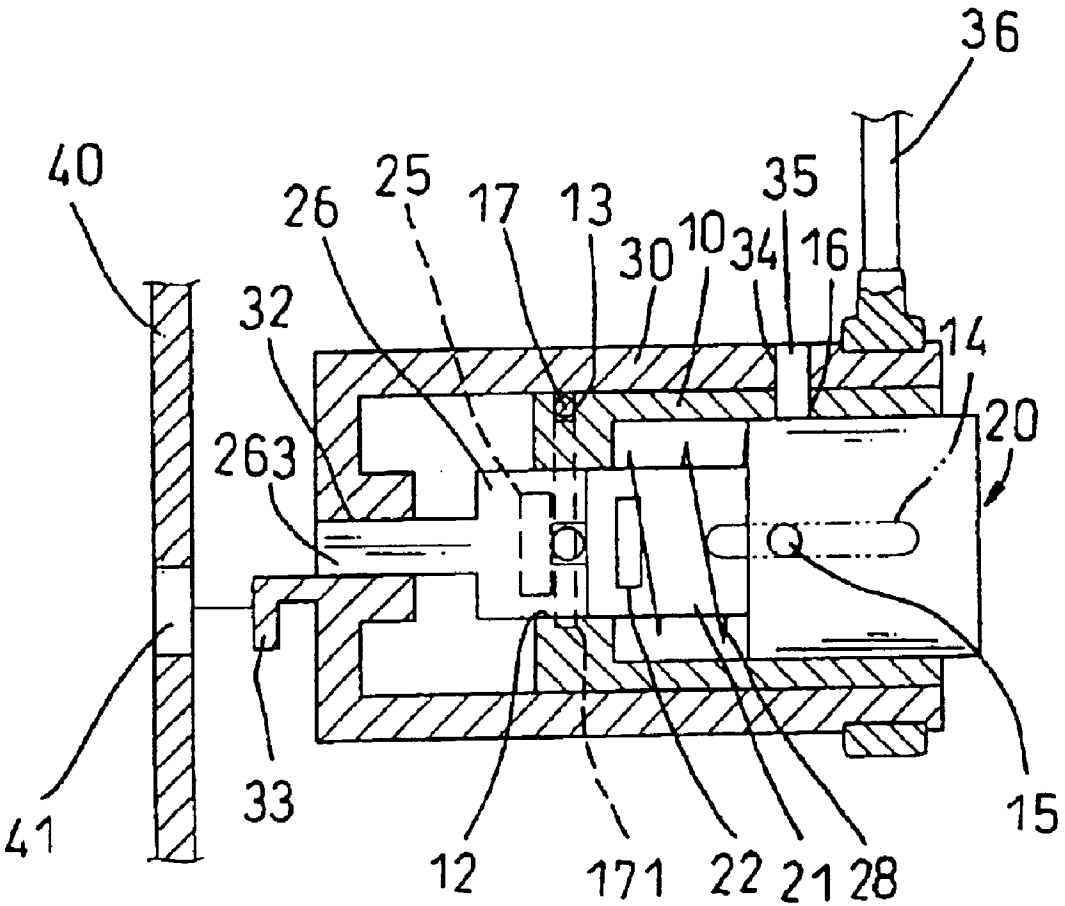
FIG. 2 is a transverse sectional view showing the article ready to be secured to the lock of FIG. 1.
Figure 3:
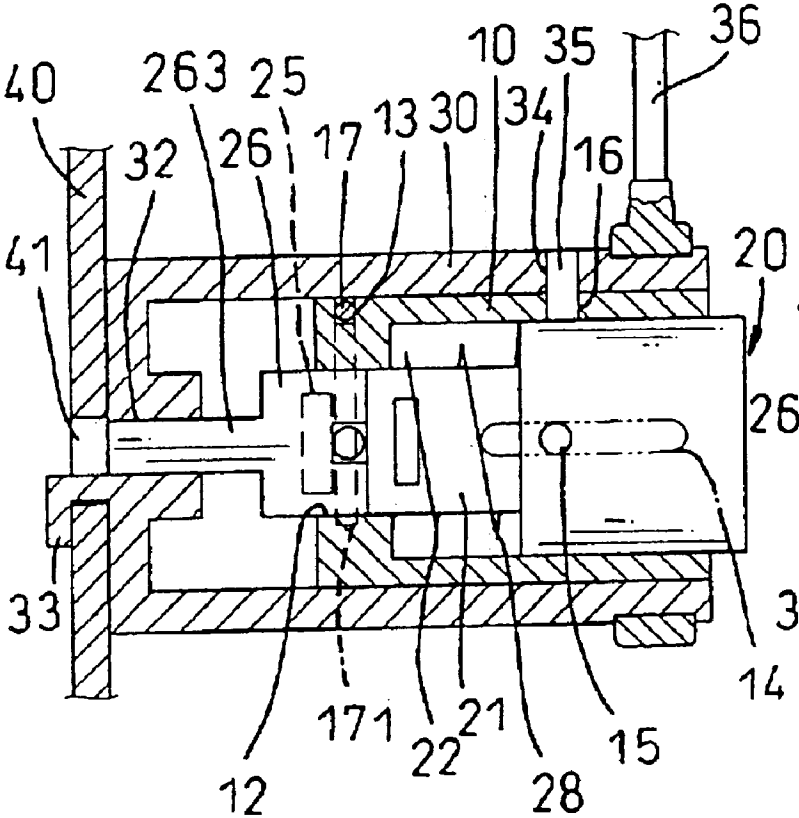
FIG. 3 is a transverse sectional view showing the article hitch to the lock of FIG. 1.
Figure 5:
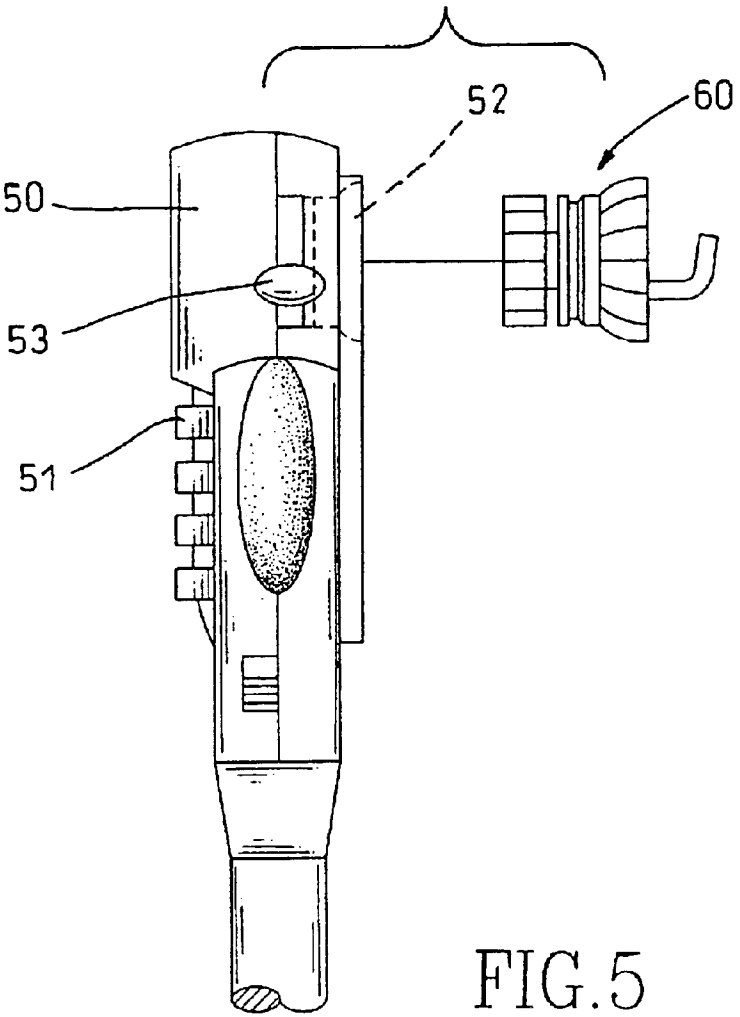
FIG.5 PRIOR ART
FIG. 5 is a side view of a prior art lock.

A cylinder (20) is movably fitted in the rear chamber (11) of the hollow body (10). The cylinder (20) has a hole (23) for receiving a stud (15) that extends into and is movable along the longitudinal groove (14), thus ensuring the correct movement of the cylinder (20) between a front position, as shown in FIG. 4, and a rear position, as shown in FIGS. 2 and 3, with respect to the hollow body (10) and hence to the casing (30).

The cylinder (20) further has a forwardly extending stem (21) that has a rear end rotatably connected to the cylinder (20) and a front end rotatably connected to a bolt (26). In the illustrated embodiment, the front end of the stem (21) is received in a rear blind hole (261) of the bolt (26) and is formed with a neck (24) defined by a frontmost disk (25), with a pin (27) extending into the neck (24) through an aperture (262) of the bolt (26), thereby allowing the front end of the stem (21) to be rotatably connecting to the bolt (26).

Figure 4:
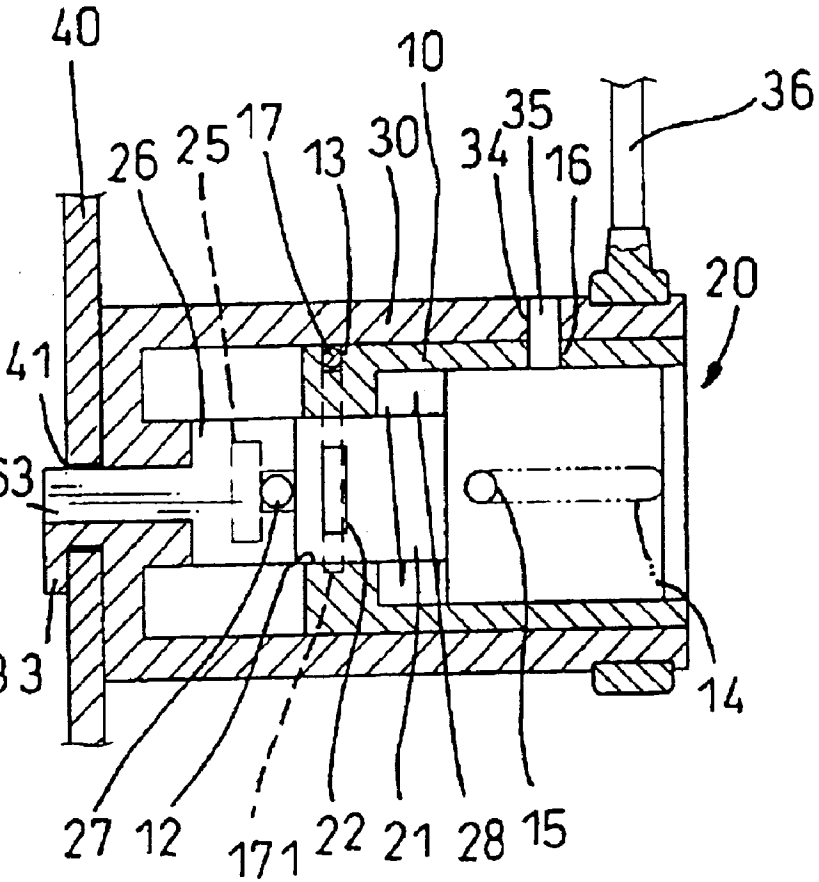
FIG. 4 is a transverse sectional view showing the article securely attached to the lock of FIG. 1.

The bolt (26) has a front lip (263) movable out of the casing (30) through the front opening (32), as best shown in FIG. 4. That is, the front lip (263) may be extended out of the casing (30) and securely held alongside the hook (33) when the cylinder (20) is moved to the front position. The front lip/second locking leg (263) may also be retracted into the casing (30) when the cylinder (20) is moved to the rear position by the action of a spring (28), which is accommodated in the rear chamber (11) of the hollow body (10) and is mounted around the stem (21) of the cylinder (20).

In the inventive lock, there are further provided means for releasably keeping said lip (263) of said bolt (26) out of said casing (30) as soon as said cylinder (20) is moved to said front position.

In a highly preferred embodiment, the means for releasably keeping the lip include a pair of opposed cutouts (22) defined in a periphery of the stem (21) and a clip (17) received in a channel (13) of the hollow body (10). In detail, the channel (13) has a pair of straight portions (131) that communicate with the front through-hole (12) substantially at two opposed tangential points, while the clip (17) is made into a U-shaped configuration and has a pair of shanks (171) resiliently flexible in the straight portions (131) of the channel (13).

These shanks (31) normally abut the periphery of the stem (21) but may snap into the cutouts (22) and catch the stem (21) as soon as the cylinder (20) is moved to its front position, thus keeping the lip (263) of the bolt (26) alongside the hook (33) of the casing (30).

Referring to FIGS. 1 and 2, the inventive lock can be assembled simply by placing the locking body (1) into the rear opening (31) before the body (1) is fastened to the casing (30), such as by means of a pintle (35) which extends into aligned orifices (34, 16) of the casing (30) and the hollow body (10).

This means that the locking body (1) may be selected from any individual lock, known or not, which has a bolt adapted to be partially and retractably extended out, particularly one in which a bolt can be partially and retractably extended out by depressing a cylinder. In other words, the inventive lock is provided with a lot of choices of the locking body, as well as easiness in its assembly.

Referring to FIGS. 2 and 3, the inventive lock is specially provided for securing an article (40) on display. As can be seen, the article (40) has a port (41) through which the hook (33) of the casing (30) can extend so as to hitch the article (40).

Referring to FIG. 4, the article (40) can be locked by depressing the cylinder (20), i.e. by moving it from the rear position to the front position. It is in the front position that the resilient shanks (171) of the U-shaped clip (17) snap into the cutouts (22) of the cylinder (20), thereby catching the stem (21) and hence keeping the lip (263) of the bolt (26) alongside the hook (33) of the casing (30).

Now that the lip (263) is kept in the port (41) and blocks the way the hook (33) may otherwise exit from the port (41). So the article on display is secured until the lock is opened.

The lock can be opened only by turning the stem (21) relative to the cylinder (20), such as by means of a correct key (not shown) that is inserted into a keyslot defined in the cylinder (20). Now the shanks (171) are both pushed outward by the turning stem (21). When the shanks (171) fully slide out of the cutouts (22) and abut the periphery of the stem (21) again, the cylinder (20) will be moved quickly from its front position (FIG. 4) back to its rear position (FIG. 3) by the action of the compressed spring (28).

As a result, the lip (263) of the bolt (26) is retracted into the casing (30) and the hook (33) may exit from the port (41) to allow the article (40) to be separated from the inventive lock.

It is to be noted that the clip (17) may be made in other configurations rather than the U-shaped one. For example, an alternative clip made in an L-shaped configuration with one single shank can also be used.

In this case, the channel (13) may be formed with only one straight portion which communicates the front through-hole (12) substantially at one tangential point, and the stem (21) may have only one cutout (22) defined therein. The L-shaped clip is received in the channel (13) with the single shank being resiliently flexible in the straight portion. Similar to the embodiment of the U-shaped configuration, the single shank normally abuts the periphery of the stem (21) but snaps into the cutout (22) and catches the stem (21) as soon as the cylinder (20) is moved to the front position.

From the above description, it is apparent that the invention has the following advantages:

1. being easy to be operated:

Because the article (40) can be locked only by depressing the cylinder (20), the inventive lock is easy to be operated.

2. being convenient to be well kept:

Because the hook (33) is formed integrally with the casing (33) and will not be lost in any way, the inventive lock is convenient to be well kept.

3. having choices of the locking body:

Because the locking body may be selected from any individual lock which has a bolt adapted to be partially and retractably extended out, the inventive lock has choices of its locking body.

4. being easy to be assembled:

Because the locking body (1) can be fastened to the casing (30) simply by inserting the pintle (35) into the aligned orifices (34, 16), the inventive lock is easy to be assembled.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. A lock for a device that includes a port defined within a wall of the device, the lock comprising:

a body;

a first locking leg for insertion into the port, the first locking leg including a shaft and an engagement portion at a distal end of the shaft that engages the wall when the first locking leg is within the port, the engagement portion being substantially perpendicular to the shaft and extending from a first side of the shaft such that the first locking leg is substantially L-shaped;

a second locking leg coupled to the body for insertion into the port adjacent the first locking leg at a second side of the first locking leg, the second locking leg being movable relative to the first locking leg and being substantially flat; and a cable coupled to the body for securing the lock to an item other than the device, a cylinder and an outer casing, the cylinder being moveable within the outer casing between an unlocked position and a locked position, wherein the second leg is coupled to the cylinder.

2. A portable lock in accordance with claim 1 wherein a spring is used to move the cylinder from the locked position to the unlocked position.

3. A lock for a device that includes a port defined within a wall of the device, the lock comprising:

a body;

a first locking leg for insertion into the port, the first locking leg including a shaft and an engagement portion at a distal end of the shaft that engages the wall when the first locking leg is within the port, the engagement portion being substantially perpendicular to the shaft and extending from a first side of the shaft such that the first locking leg is substantially L-shaped;

a second locking leg coupled to the body for insertion into the port adjacent the first locking leg at a second side of the first locking leg, the second locking leg being movable relative to the first locking leg and being substantially flat; and a cable coupled to the body for securing the lock to an item other than the device, wherein the second locking leg wherein the second locking leg does not extend beyond the first locking leg.

* * * * *